US011353308B2

(12) United States Patent
Lopez De Cardenas et al.

(10) Patent No.: US 11,353,308 B2
(45) Date of Patent: Jun. 7, 2022

(54) SELF-SELECTING SWITCH DEVICES, PERFORATING GUN SYSTEMS INCLUDING THE SELF-SELECTING SWITCH DEVICES, AND METHODS OF USING THE GUN SYSTEMS

(71) Applicants: Jorge E. Lopez De Cardenas, Sugar Land, TX (US); Timothy Al Andrzejak, Sugar Land, TX (US)

(72) Inventors: Jorge E. Lopez De Cardenas, Sugar Land, TX (US); Timothy Al Andrzejak, Sugar Land, TX (US)

( * ) Notice: Subject to any disclaimer, the term of this patent is extended or adjusted under 35 U.S.C. 154(b) by 188 days.

(21) Appl. No.: 16/870,857

(22) Filed: May 8, 2020

(65) Prior Publication Data

US 2020/0355482 A1 Nov. 12, 2020

Related U.S. Application Data

(60) Provisional application No. 62/845,298, filed on May 8, 2019.

(51) Int. Cl.

| | |
|---|---|
| ***F42D 1/055*** | (2006.01) |
| ***E21B 43/1185*** | (2006.01) |
| ***E21B 43/117*** | (2006.01) |

(52) U.S. Cl.

CPC ..... *F42D 1/055* (2013.01); *E21B 43/117* (2013.01); *E21B 43/1185* (2013.01)

(58) Field of Classification Search

CPC .. E21B 43/1185; E21B 43/11857; F42D 1/05; F42D 1/055

See application file for complete search history.

(56) References Cited

U.S. PATENT DOCUMENTS

| | | | | |
|---|---|---|---|---|
| 9,915,513 | B1 | 3/2018 | Zemla | |
| 10,180,050 | B2 | 1/2019 | Hardesty | |
| 2004/0108114 | A1* | 6/2004 | Lerche | E21B 43/119 166/302 |
| 2018/0224260 | A1* | 8/2018 | Zemla | F42D 1/055 |

* cited by examiner

*Primary Examiner* — Robert E Fuller

(57) ABSTRACT

Self-selecting switch devices, perforating gun systems including the devices, and methods of using the gun systems are provided herein. A self-selecting switch device includes a microcontroller, a logic circuit, and a first switch. The microcontroller is configured for direct operative connection to a shooting panel and to other self-selecting switch devices, wherein the microcontroller is programmed to detect a presence of other self-selecting switch devices that are operatively connected thereto. The first switch is operative to electrically connect a shooting panel to a detonator. The first switch is under operational control of the microcontroller. The logic circuit is in electrical communication with the microcontroller and the first switch. The logic circuit is configured to selectively direct electrical current to the microcontroller or to the first switch.

16 Claims, 4 Drawing Sheets

SELF-SELECTING SWITCH DEVICES, PERFORATING GUN SYSTEMS INCLUDING THE SELF-SELECTING SWITCH DEVICES, AND METHODS OF USING THE GUN SYSTEMS

CROSS-REFERENCE TO RELATED APPLICATIONS

This application claims the benefit of U.S. Provisional Application No. 62/845,298, filed May 8, 2019.

TECHNICAL FIELD

The technical field generally relates to perforating gun initiating devices, perforating gun systems including the initiating devices, and methods of using the gun systems. More particularly, the technical field relates to initiating devices and perforating gun systems including multiple perforating guns connected in a string and that can each be selectively initiated using the initiating devices.

BACKGROUND

After a well has been drilled into a formation to form a wellbore and casing has been cemented in the wellbore, perforations into pay zones are created to allow communication of fluids between the pay zones in the formation and the wellbore. Shaped charge perforating is commonly used. As shown in FIG. 1, perforating is commonly performed using a perforating gun 6 in which conical shaped charges 7 are mounted in the perforating gun with the perforating gun 6 conveyed into a well 3 on either a cable 1 (e.g., an electric wireline or slick line) or tubing (e.g. production tubing, drill pipe, or coiled tubing). Shaped charges 7 are directional explosive devices that, upon detonation, generate a high velocity jet of material.

As shown in FIG. 1, conventional perforating guns 6 contain multiple shaped charges 7. The individual shaped charges 7 within the perforating gun 6 are operatively connected via a length of detonating cord (not shown in FIG. 1). Conventional perforating guns 6 also contain a detonator (not shown in FIG. 1) that is installed in operative communication with the detonating cord. Detonators can detonate the shaped charges 7 in a variety of manners, including by providing an electrical signal, a pressure pulse, a pyrotechnic fuse, and/or a percussion/impact. Upon activating the detonator, a detonation wave passes along the detonating cord that sequentially detonates each shaped charge within the perforating gun. A high velocity jet produced from each shaped charge creates a perforation through the well casing and into pay zones of the formation.

"Well Completion" is a term that collectively refers to the oilfield well-construction activities that prepare a given well for hydrocarbon production and includes the operations of cementing and perforating. During Well Completion operations, it may be necessary to perforate at different spatial intervals within a well. Scenarios where this may be necessary include: (1) vertical wells with multiple hydrocarbon zones, (2) vertical wells that are being hydraulically fractured, and (3) horizontal wells that are being hydraulically fractured. To achieve a higher operational efficiency in these situations, conventional approaches have involved conveying multiple perforating guns together in a single tool string into the well. A common method for conveying multiple guns into a well is to connect the guns to the wireline cable on a single downhole tool string. In this scenario, a device on each gun that establishes an electrical connection from the wireline to the detonator within each gun is used to individually fire each gun at a precise moment and depth.

Hydraulic fracturing is a technique sometimes used in the oilfield to access and produce a greater proportion of hydrocarbons from a given reservoir. Hydraulic fracturing generally involves pumping a fluid into a well at high pressure, which traverses through the well's perforations and into the oil/gas reservoir. The high-pressure fluid produces fractures within the reservoir to improve the efficiency of hydrocarbon extraction. Because of the very low permeability of shale reservoirs, horizontal wells with multiple hydraulic fractures are needed to extract hydrocarbons economically. Hydraulic fracturing operations in horizontal wells typically involve multiple stages. Each hydraulic fracturing stage utilizes multiple perforating guns to generate perforation clusters at different intervals along the well.

All the perforating guns used for each stage are typically conveyed into a well at the same time using a wireline cable. The perforating guns are physically connected to each other in a perforating string and may be operatively connected for detonation. The horizontal orientation of the well requires that a fluid be pumped down the wellbore to position the perforating guns in the proper location in the well. Once the perforating guns are at the proper location in the well, a single gun in the string must be initiated to produce a first cluster of perforations. The conventional practice is that the last gun in the perforating string (i.e. the furthest gun from a mouth of the wellbore) is the first to be initiated. The wireline is then pulled to position the next gun in the perforating string in the next desired location in the wellbore that is to be perforated. The last un-fired gun in the perforating string must then be initiated. This process is repeated until all the perforating guns in the perforating string have been fired.

Multiple methods exist for individually firing perforating guns that are co-located within a given well, including: (1) Dual Diode Systems, (2) Ballistic Delay Fuses, (3) Mechanical Switch Systems, and (3) Addressable Switch Systems.

Dual Diode Systems can be used when a wellbore needs to be perforated at two separate hydrocarbon or pay zones within a reservoir. The Dual Diode System enables the individual initiation of one gun in a two-gun perforating string. A shooting panel located outside of the wellbore is used to deliver either positive or negative DC voltage to the wireline cable connected to the perforating guns. The Dual Diode System in the guns uses diodes to direct the different voltage polarities (i.e. positive voltage or negative voltage) to the detonators in the two perforating guns. The main disadvantage of Dual Diode Systems is the limited number of guns that can be conveyed in a single perforating string.

Ballistic Delay Fuses can be used to operatively connect the shaped charges among the different perforating guns. A single detonator is used to initiate the first gun, which in turn ignites a pyrotechnic fuse. The fuse burns for a prescribed time prior to initiating a mass of primary explosive that transitions from burning to detonation. The primary explosive then detonates and initiates the detonating cord in the next gun. While the pyrotechnic fuse is burning, the wireline or slickline cable is used to convey the next gun in the perforating string to the next interval of the well that is to be perforated. This process is repeated until all the guns in the perforating string have been initiated. Drawbacks to the Ballistic Delay Fuse system include: (1) the pyrotechnic burning rate is influenced by temperature and is unpredictable, (2) the guns in the perforating string must be moved to the proper locations in the well over a short period of time which can result in off-depth perforations, and (3) the detonation of guns in the perforating string cannot be effectively controlled once the first gun is initiated. Owing to the aforementioned disadvantages, Ballistic Delay Fuses are rarely used in wireline conveyed perforating guns.

Mechanical Switch Systems operate by keeping the detonator electrically disconnected until the adjacent gun has been initiated. Forces exerted on the switch from detonation of the adjacent gun induce the movement of a mechanism within the switch that completes a circuit with the detonator. Mechanical Switch Systems have been used for many years within oilfield perforating guns and are known to result in elevated failure rates. The failure of a Mechanical Switch System is problematic because the misfired gun cannot be bypassed and all the remaining perforating guns in the assembly cannot be armed and initiated. It follows that in scenarios where a Mechanical Switch System has failed, the perforating string must be pulled from the wellbore resulting in lost time and additional costs.

Addressable Switch Systems are more reliable than Mechanical Switch Systems and offer the additional advantage of enabling bypass of misfired guns. Addressable Switch Systems employ a uniquely identifiable switch that is electrically connected to the detonator in each perforating gun. A typical Addressable Switch System includes multiple wiring connections, including a communication line from a special shooting panel to a specific addressable switch. The shooting panel is connected to the wireline cable at the surface, outside of the wellbore, that is used to select the specific addressable switch by sending a unique address into the system through the communication line. The specified switch then electrically connects a detonator/shooting line to a switch line to arm its corresponding detonator. The shooting panel is then able to deliver the firing voltage to the detonator to initiate the perforating gun. In the event of a detonator misfire or addressable switch failure, the next switch in the gun assembly can be addressed using the shooting panel to arm its detonator through the communication line. A disadvantage of this type of system is the need of a specialized shooting panel or a control box for the command of the addressable switches in the tool string.

Other systems exist that rely on more complex circuitry to detect the detonation of a perforating gun and select and arm the next perforating gun to be initiated. Accordingly, it is desirable to provide initiating devices that are capable of functioning with conventional shooting panels while enabling misfired detonators to be bypassed. Furthermore, other desirable features and characteristics of the present disclosure will become apparent from the subsequent detailed description and the appended claims, taken in conjunction with the accompanying drawings and this background.

BRIEF SUMMARY

Self-selecting switch devices, perforating gun systems including the self-selecting switch devices, and methods of using the perforating gun systems are provided herein. In an embodiment, a self-selecting switch device includes a microcontroller, a logic circuit, and a first switch. The microcontroller is configured for direct operative connection to a shooting panel and to other self-selecting switch devices, wherein the microcontroller is programmed to detect a presence of other self-selecting switch devices that are operatively connected thereto. The first switch is operative to electrically connect a shooting panel to a detonator. The first switch is under operational control of the microcontroller. The logic circuit is in electrical communication with the microcontroller and the first switch. The logic circuit is configured to selectively direct electrical current to the microcontroller or to the first switch.

In another embodiment, a perforating gun system is provided. The perforating gun system includes a shooting panel and a perforating gun string. The perforating gun string is in electrical communication with the shooting panel and includes an upline perforating gun and a downline perforating gun in electrical communication with the upline perforating gun. The upline perforating gun includes a first self-selecting switch device, a first detonator in electrical communication with the first self-selecting switch device, and at least one shaped charge detonatable by the first detonator. The downline perforating gun includes a second self-selecting switch device operatively connected to the first self-selecting switch device, a second detonator in electrical communication with the second self-selecting switch device, and at least one shaped charge detonatable by the second detonator. The first and second self-selecting switch devices are as described above.

In another embodiment, a method of using a perforating gun system is provided. The method includes providing a perforating gun system as described above, determining which switch device is located within a last un-fired gun in the perforating string using the microcontrollers of the respective self-selective switch devices, and initiating the detonator based on the determination of the last un-fired gun in the perforating string.

BRIEF DESCRIPTION OF THE DRAWINGS

The various embodiments will hereinafter be described in conjunction with the following drawing figures, wherein like numerals denote like elements, and wherein.

DETAILED DESCRIPTION

Figure 1:
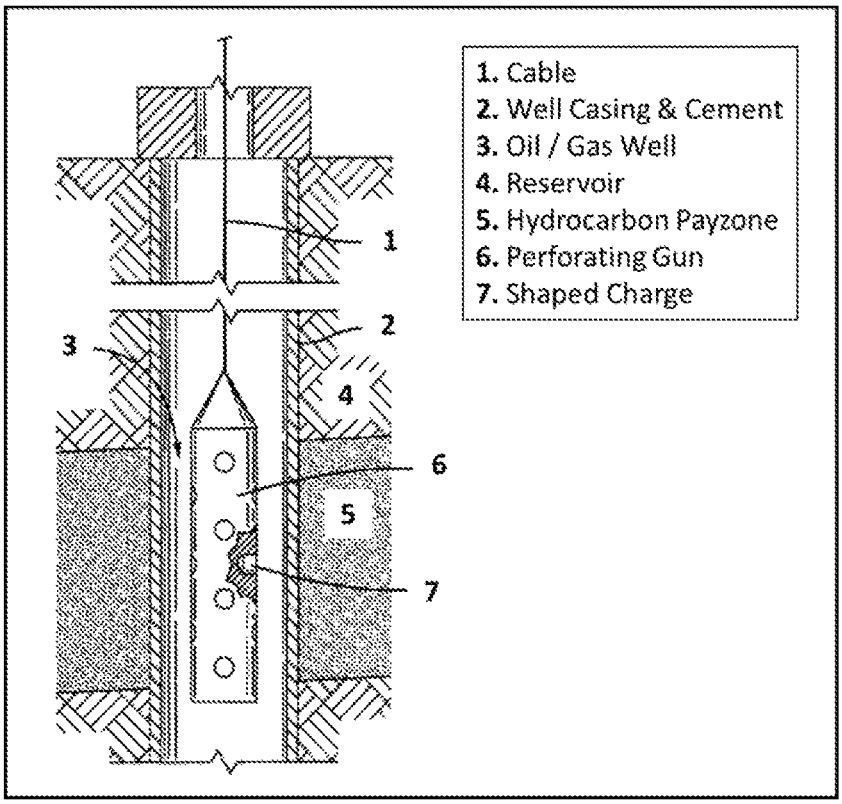
FIG. 1 (PRIOR ART)
FIG. 1 is a schematic diagram illustrating a hollow-carrier perforating gun within a well.

The following detailed description is merely exemplary in nature and is not intended to limit the perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate. As used herein, "upline" and "downline" refer to positions of perforating guns along a perforating gun string relative to a shooting panel, with downline positions further away in series from upline positions.

The subject matter described here is a self-selecting switch device, a perforating gun system including at least two perforating guns each having a self-selecting switch device, and methods of using the perforating gun system for, e.g., perforating an oil or natural gas well. As shown schematically in FIG. 4, the self-selecting switch devices 10 include a microcontroller 20 configured for direct operative connection to a shooting panel 12 and to other self-selecting switch devices. A first switch 24 is operative to electrically connect the shooting panel 12 to a detonator 21, wherein the first switch 24 is under operational control of the microcontroller 20 (either directly or through an additional switch controller 30). The microcontroller 20, which may be a programmable logic controller (PLC), is programmed to detect the presence of other active self-selecting switch devices 10 that are operatively connected thereto, along a perforating string, through information provided by the switch devices 10. The "operative connection" may be a physical connection, e.g., through wiring, or may be an informational connection facilitated through wireless communication. The microcontroller 20 of different switch devices 10 may further be programmed to cooperatively determine a most downline self-selecting switch device 10 operatively connected thereto, and may also be programmed to auto-selectively arm a detonator (e.g., by closing switch 24 and opening switch 25) in the most downline un-fired gun in the string using a switch device 10 associated with the last un-fired gun in the string 13. However, it is to be appreciated that in embodiments, such determinations can alternatively be made by an external processor that is separate from and in informational communication with the switch devices. A special feature of perforating gun systems 11 including the switch devices 10 having a microcontroller programmed as described is that mono-cable (wireline or slick line) or wireline cables containing multiple electrical wires (often referred to as "conductors") can be used. Such capabilities are enabled due to the presence of a logic circuit 19 that is configured to selectively direct electrical current to the microcontroller 20 or to switch 24 that electrically connects the shooting panel 12 to the detonator 21. In particular, the logic circuit 19 can include diodes 22, 23 that are configured to direct current to either the microcontroller 20 or to the switch 24 based on polarity of the current (e.g., positive or negative DC voltage), thereby enabling a single current source to be employed that is capable of operating the microcontroller 20 and that is also capable of providing electrical current to activate the detonator 21. However, it is to be appreciated that alternative transistor configurations can be employed in the logic circuit that enable current to be selectively directed to the microcontroller or to the switches.

Figure 2:
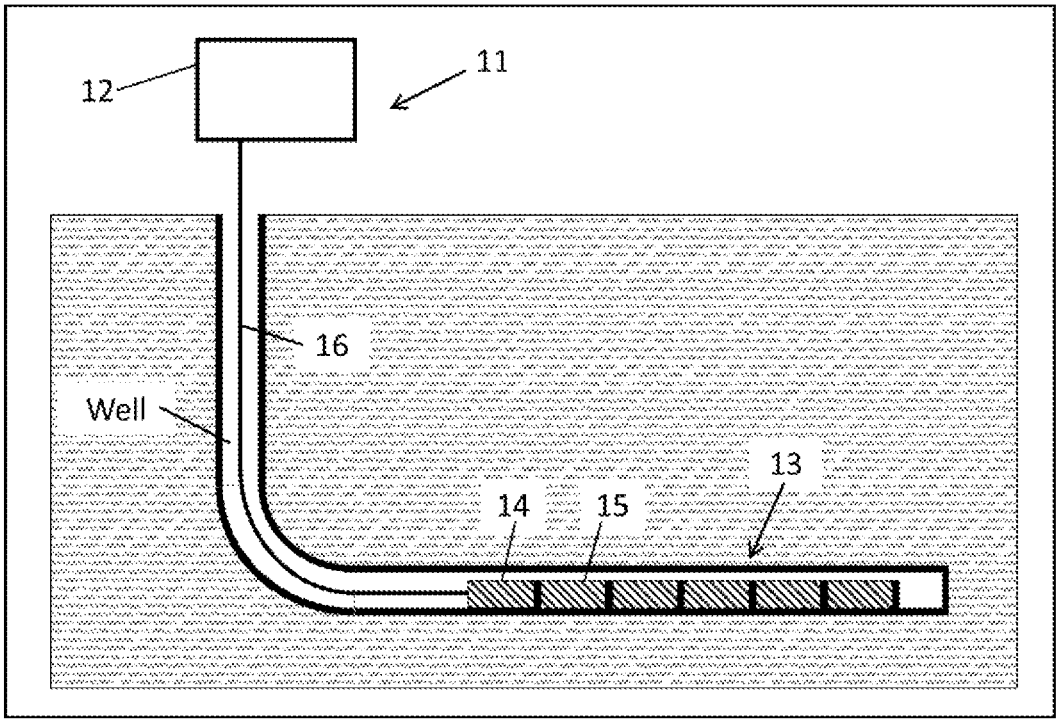
FIG. 2 is a schematic diagram illustrating a shooting panel electrically connected to a perforating gun string.
Figure 3:
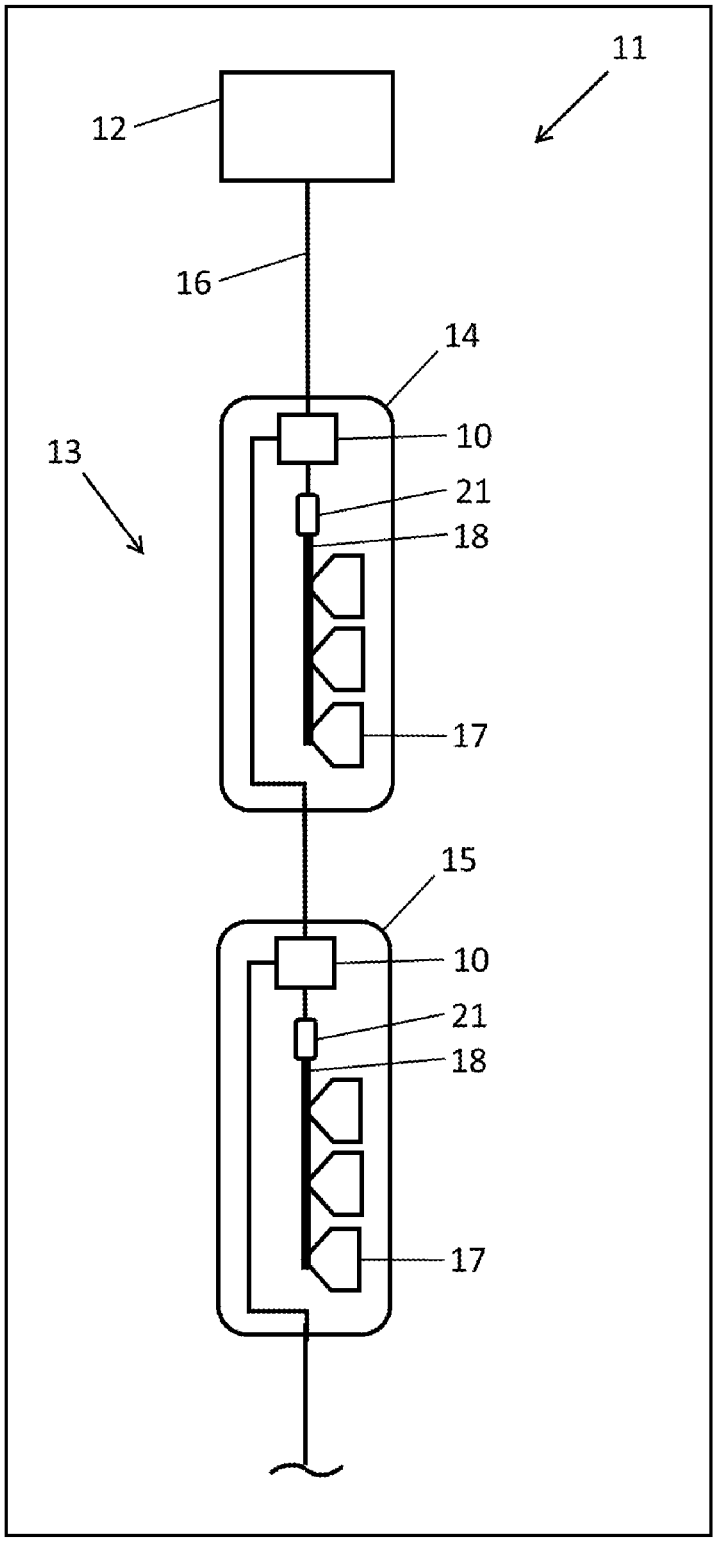
FIG. 3 is a schematic diagram of a perforating gun system including a self-selecting switch device.
Figure 4:
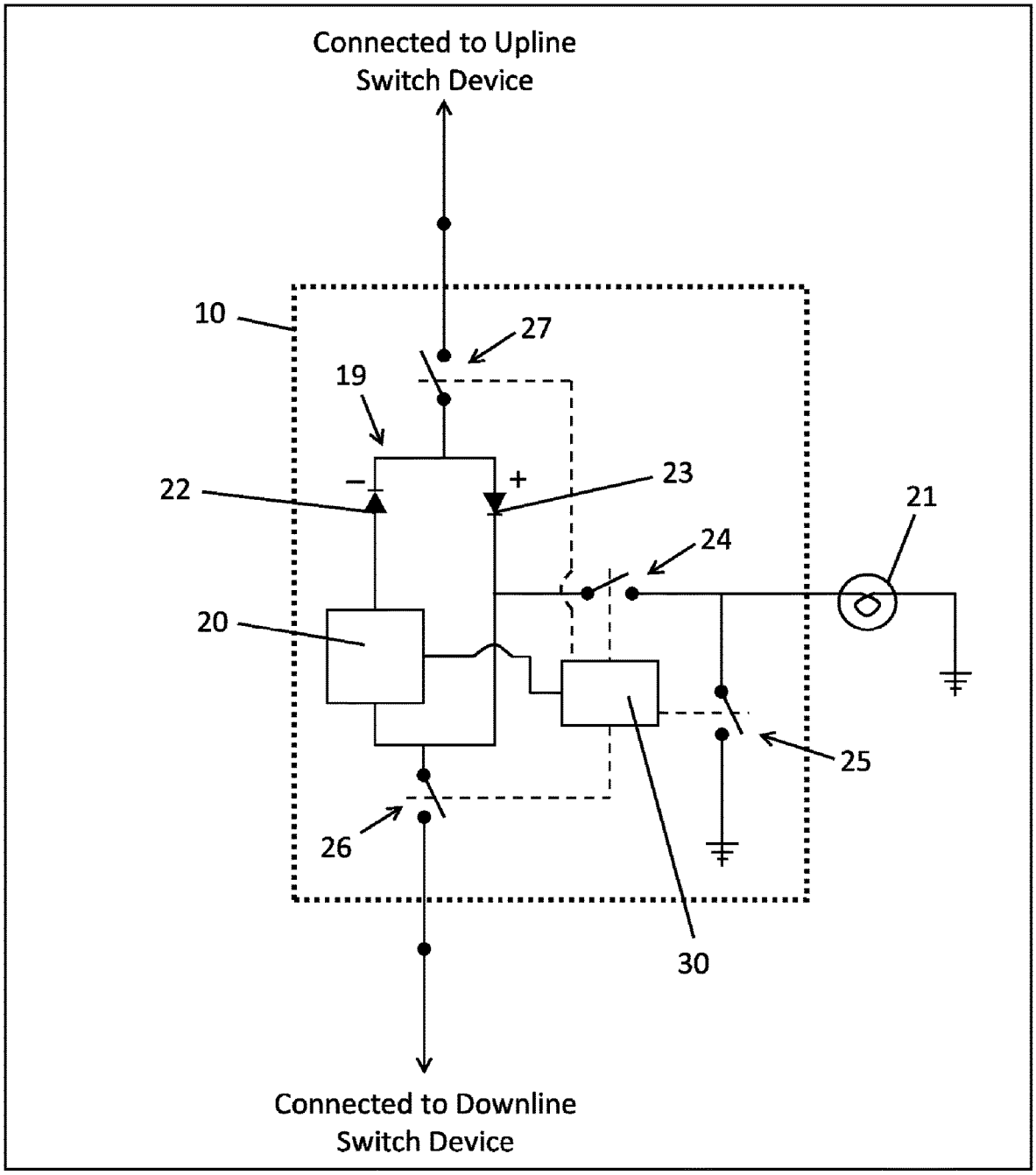
FIG. 4 is an electrical circuit diagram of the self-selecting switch shown schematically in FIG. 3.

FIG. 2 depicts an exemplary perforating gun system 11 including a shooting panel 12 and a perforating gun string 13 in electrical communication with the shooting panel 12. In this embodiment, the shooting panel 12 is connected to the perforating gun string 13 through a wireline cable 16. The perforating gun string 13 includes an upline perforating gun 14 and a downline perforating gun 15 in electrical communication with the upline perforating gun 14. The perforating guns 14, 15 may be electrically connected in series. In embodiments, the shooting panel 12 is configured to selectively supply positive or negative DC voltage to the perforating gun string 13 through the wireline cable 16. In an embodiment and referring momentarily to FIG. 4, the self-selecting switch device 10 includes a logic circuit 19 having diodes 22, 23 with one diode 22 controlling electrical current to the microcontroller 20 and the other diode 23 controlling electrical current to a detonator 21 when switch 24 is closed and switch 25 is open. In operation, a first voltage polarity is used to operate the microcontroller 20 with diode 22 configured to pass electrical current to the microcontroller at the first voltage polarity, and a second opposite polarity is used to activate the detonator 21 with diode 23 configured to pass electrical current to the detonator 21 at the second polarity. In embodiments, through operation of the microcontrollers 20 in the respective switch devices 10, a determination may be made regarding which switch device 10 is located within the last un-fired gun in the perforating string 13. Referring to FIG. 4, the switch device 10 includes a first switch 24, which is operative to arm the detonator 21. Optionally, the switch device 10 further includes a second switch 25 to shunt the detonator 21 to ground when the detonator 21 is not armed, a third switch 26, and/or or fourth switch 27 that are operative to connect and disconnect a given self-selecting switch device 10 from the other self-selecting switch devices 10 immediately upline or downline thereto in the perforating gun string 13, thus enabling further control and selective detonation of specific perforating guns 14, 15 in the perforating gun string 13. However, it is to be appreciated that effective operation of the self-selecting switch device 10 is possible without the second switch 25, the third switch 26, and the fourth switch 27. Determinations regarding which switch device 10 is located within the last un-fired gun in the perforating string 13 may be made exclusively between the switch devices 10 through communication with each other, particularly through communication between microcontrollers 20 of the respective switch devices 10, with the determinations optionally communicated to the shooting panel 12 or other external device (such as a portable computing device). For example, in embodiments, voltage of the first polarity is applied to the microcontroller 20 to determine which switch device 10 is located within the last un-fired gun in the perforating string 13. Alternatively, the determinations can be made with an external processor or circuit that gathers data from the microcontrollers 20 in the respective switch devices 10. The microcontroller 20 of the switch devices 10 may be programmed to assure that the switch device 10 in the last un-fired gun is the only one that can be used to arm its corresponding detonator 21. Alternatively, the switch devices 10 can be controlled by the external processor to effectuate such function. The second, opposite voltage polarity may then be applied from outside of the wellbore (e.g. with the shooting panel) to initiate the detonator through function of the logic circuit 19.

In an embodiment and as shown in FIG. 4, when, for example, negative DC voltage is applied to the self-selecting switch device 10, the diode 22 passes the current and microcontroller 20 is energized while diode 23 effectively blocks current to the detonator 21. To comply with safety regulations, the current used with the first polarity should be no more than the detonator's maximum no-fire current, for example less than 10 mA. As alluded to above, first switch 24, optional second switch 25, optional third switch 26, and optional fourth switch 27 are under operational control of the microcontroller 20. In embodiments, the switches 24, 25, 26, 27 are directly controlled by microcontroller 20. In other embodiments and as shown in FIG. 4, a switch controller 30 is operatively connected to the microcontroller 20 and to the switches 24, 25, 26, 27. In embodiments, the switch controller 30 is isolated from direct operative connection to the shooting panel 12 and to other self-selecting switch devices 10 by the microcontroller 20, i.e., the switch controller 30 is directly electrically connected to the microcontroller 20 and the switches 24, 25, 26, 27 only. In the embodiment of FIG. 4, the microcontroller 20 communicates with the switch controller 30 to open or close the switches 24, 25, 26, 27. Voltage of the same polarity used to determine which switch device 10 is located within the last un-fired gun 14, 15 (e.g., the first polarity) may also be applied to the microcontroller 20 to operate the switch controller 30. The switches can be, for example, Micro-Electro-Mechanical-Systems (MEMS) switches or Switch Electronic Circuits (SEC). The optional third switch 26 can be used to disconnect the immediately downline self-selecting switch device. The optional second switch 25 serves to safely shunt the detonator 21 to ground when it is not armed, wherein the second switch is located between a ground and the detonator 21. The first and second switches 24, 25 may be in direct electrical communication, i.e., part of the same electrical line with no intervening switches or devices and with the second switch 25 downline from the first switch in the direction of the detonator 21. The first switch 24 is used to arm the detonator 21 when closed. The optional fourth switch 27 can disconnect the self-selecting switch device 10 from the immediately upline self-selecting switch device in the event of a misfire.

Figure 5:
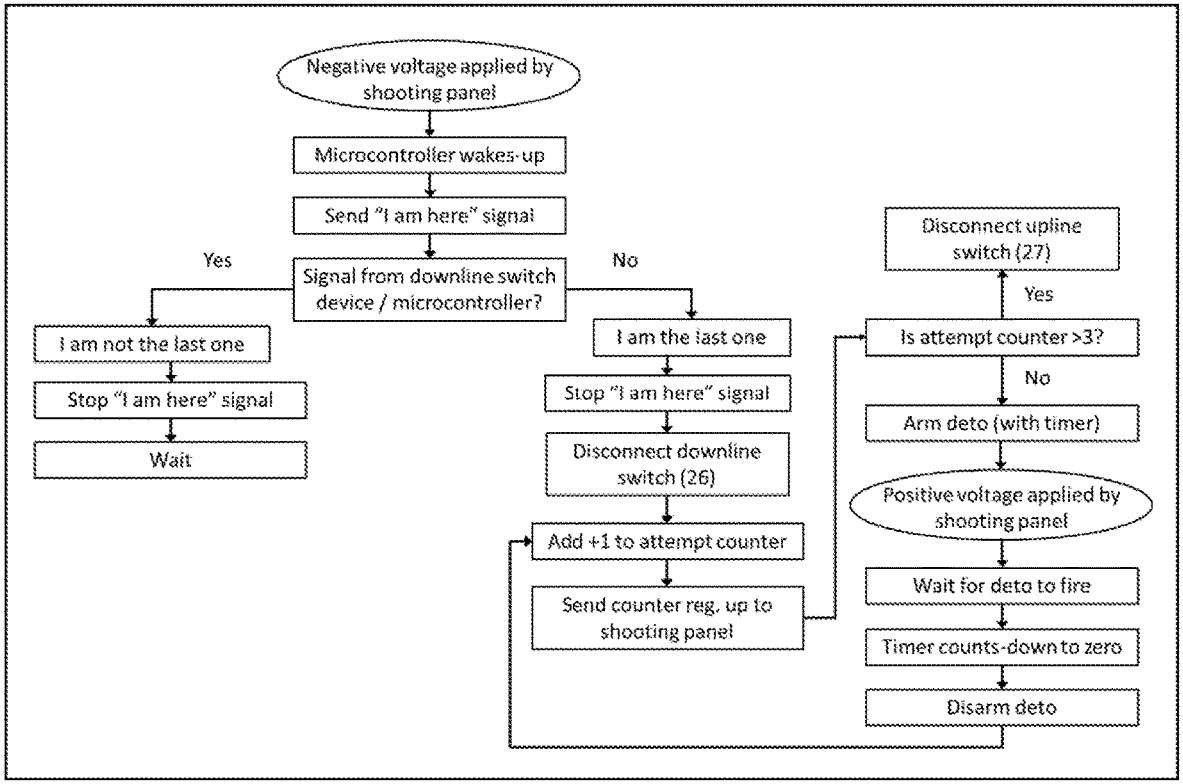
FIG. 5 is a flow chart detailing an embodiment of the logic used by a self-selecting switch to arm a detonator.
Figure 6:
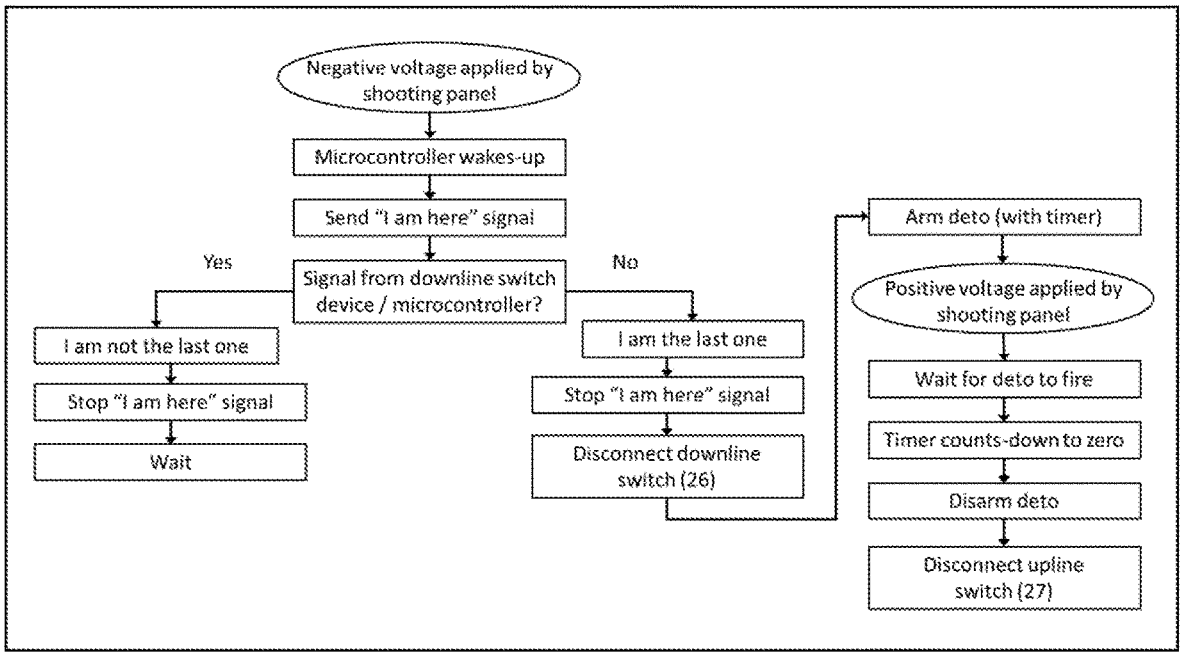
FIG. 6 is a flow chart detailing another embodiment of the logic used by a self-selecting switch to arm a detonator.

Flow charts are provided in FIGS. 5 and 6 that detail two logic scenarios that can be programmed to the microcontroller 20. Upon detonation of a perforating gun 14, 15, the self-selecting switch device 10 in the gun 14, 15 may be disabled by the detonation shock. To ensure that the self-selecting switch device 10 is destroyed or disconnected during gun detonation, the switch device 10 or its lead wires can be located adjacent to the detonator 21 or in the proximity of shaped charge(s) 17. As shown in the flow charts in FIGS. 5 and 6, if the switch device 10 is still active, the microcontroller 20 may send a signal indicating its active status (e.g., to the shooting panel 12 or a portable computing device) immediately after waking-up. If the microcontroller 20 detects a signal from an immediately preceding switch device 10, then it may determine that it is not associated with the last un-fired gun 14, 15 of the string 13. If no signal is detected from the immediately downstream switch device, then the microcontroller 20 may determine that it is associated with the last un-fired gun 14, 15 in the string and will arm the detonator 21. More specifically, the microcontroller 20 may command the switch controller 30 to close the first switch 24 and open the second switch 25 to electrically connect the detonator 21 and un-shunt the detonator 21 respectively. Optionally, the microcontroller 20 may further command the switch controller 30 to open the third switch 26 (when present) to disconnect the immediately downstream switch device 10. The operator at the surface may then use a power supply or the shooting panel 12 to send the opposite polarity voltage (e.g., the second polarity) through the wireline cable 16, with diode 23 of the logic circuit 19 passing the current to initiate the detonator 21.

In embodiments, in the event that a gun 14, 15 is to misfire, the misfired gun's self-selecting switch device 10 can be bypassed since it would still be active. As shown in FIG. 5, the microcontroller 20 may allow N attempts (for example 3) to successfully initiate the detonator 21. If the switch device 10 is still functional after the N attempts, then the microcontroller 20 may command the switch controller 30 to open the fourth switch 27 and disconnect itself from the immediately upline switch device 10. This feature can also be used if for any reason it is desired to bypass a particular gun 14, 15. In this case, a gun 14, 15 can be armed (N+1) times without sending the second polarity to fire the detonator 21. Alternatively, as shown in FIG. 6, the self-selecting switch device 10 could disconnect itself from the immediately upline switch device 10 after a single failed attempt to fire. In this scenario, a timer may be started upon arming the detonator 21. If the detonator 21 has not fired after a predetermined period of time, then the microcontroller 20 can command the switch controller 30 to disarm the detonator 21 by opening the first switch 24 and disconnect itself from the immediately upline switch device 10 by opening the fourth switch 27.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It being understood that various changes may be made in the function and arrangement of elements described in an exemplary embodiment without departing from the scope of the present disclosure as set forth in the appended claims.

What is claimed is:

1. A self-selecting switch device comprising:

a microcontroller configured for direct operative connection to a shooting panel and to other self-selecting switch devices, wherein the microcontroller is programmed to detect a presence of other self-selecting switch devices that are operatively connected thereto;

a first switch operative to electrically connect the shooting panel to a detonator, wherein the first switch is under operational control of the microcontroller; and a logic circuit in electrical communication with the microcontroller and the first switch, wherein the logic circuit is configured to selectively direct electrical current to the microcontroller or to the first switch.

2. The self-selecting switch device of claim 1, wherein the logic circuit is configured to receive positive or negative DC voltage.

3. The self-selecting switch device of claim 2, wherein the logic circuit includes a first diode and a second diode, whereby the first diode is configured to pass current of a first polarity to the microcontroller and the second diode is configured to block current of the first polarity to the detonator.

4. The self-selecting switch device of claim 3, wherein the second diode is configured to pass electrical current to the detonator at a second polarity that is opposite the first polarity.

5. The self-selecting switch device of claim 1, further comprising a second switch located between a ground and the detonator wherein the second switch is operative to shunt the detonator.

6. The self-selecting switch device of claim 1, further comprising a switch controller operatively connected to the microcontroller and to the switches.

7. The self-selecting switch device of claim 6, wherein the switch controller is isolated from direct operative connection to the shooting panel and to other self-selecting switch devices by the microcontroller.

8. The self-selecting switch device of claim 1, further comprising a third switch and/or or fourth switch that are operative to connect and disconnect the self-selecting switch device from other self-selecting switch devices upline or downline thereto in a perforating string.

9. The self-selecting switch device of claim 1, wherein the microcontroller is further programmed to cooperatively determine a most downline self-selecting switch device operatively connected thereto.

10. The self-selecting switch device of claim 9, wherein the microcontroller is further programmed to auto-selectively arm a detonator in the most downline un-fired gun in the string.

11. The self-selecting switch device of claim 10, wherein the device is configured for voltage of the same polarity used to determine which switch device is located within the last un-fired gun to also be applied to the microcontroller to selectively arm the detonator.

12. The self-selecting switch device of claim 11, wherein the device is further configured for an opposite voltage polarity, as compared to the voltage polarity used to determine which switch device is located within the last un-fired gun, to initiate the detonator through function of the logic circuit.

13. A perforating gun system comprising:

a shooting panel;

a perforating gun string in electrical communication with the shooting panel, wherein the perforating gun string comprises an upline perforating gun and a downline perforating gun in electrical communication with the upline perforating gun;

wherein the upline perforating gun comprises a first self-selecting switch device, a first detonator in electrical communication with the first self-selecting switch device, and at least one shaped charge detonatable by the first detonator;

a downline perforating gun comprising a second self-selecting switch device operatively connected to the first self-selecting switch device, a second detonator in electrical communication with the second self-selecting switch device, and at least one shaped charge detonatable by the second detonator;

wherein the first and second self-selecting switch devices comprise:

a microcontroller configured for direct operative connection to a shooting panel and to other self-selecting switch devices, wherein the microcontroller is programmed to detect a presence of other self-selecting switch devices that are operatively connected thereto;

a first switch operative to electrically connect the shooting panel to the detonator in electrical communication with the respective self-selecting switch device, wherein the first switch is under operational control of the microcontroller; and a logic circuit in electrical communication with the microcontroller and the first switch, wherein the logic circuit is configured to selectively direct electrical current to the microcontroller or to the first switch.

14. The perforating gun system of claim 13, wherein the shooting panel is configured to selectively supply positive or negative DC voltage to the perforating gun string.

15. The perforating gun system of claim 13, wherein the self-selecting switch device includes diodes whereby a first voltage polarity is used to operate the microcontroller, and a second voltage polarity opposite the first voltage polarity is used to activate the detonator in electrical communication with the respective self-selecting switch device.

16. A method of using a perforating gun system comprising:

providing a perforating gun system comprising:

a shooting panel;

a perforating gun string in electrical communication with the shooting panel, wherein the perforating gun string comprises an upline perforating gun and a downline perforating gun in electrical communication with the upline perforating gun, wherein the upline perforating gun comprises a first self-selecting switch device, a first detonator in electrical communication with the first self-selecting switch device, and at least one shaped charge detonatable by the first detonator;

a downline perforating gun comprising a second self-selecting switch device operatively connected to the first self-selecting switch device, a second detonator in electrical communication with the second self-selecting switch device, and at least one shaped charge detonatable by the second detonator;

wherein the first and second self-selecting switch devices comprise:

a microcontroller configured for direct operative connection to a shooting panel and to other self-selecting switch devices, wherein the microcontroller is programmed to detect a presence of other self-selecting switch devices that are operatively connected thereto;

a first switch operative to electrically connect the shooting panel to the detonator in electrical communication with the respective self-selecting switch device, wherein the first switch is under operational control of the microcontroller; and a logic circuit in electrical communication with the microcontroller and the first switch, wherein the logic circuit is configured to selectively direct electrical current to the microcontroller or to the first switch;

determining which switch device is located within a last un-fired gun in the perforating string using the microcontrollers of the respective self selecting switch devices; and initiating the detonator in electrical communication with the respective self-selecting switch device based on the determination of the last un-fired gun in the perforating string.

* * * * *